US011322090B2

(12) United States Patent
Xu

(10) Patent No.: US 11,322,090 B2
(45) Date of Patent: May 3, 2022

(54) PIXEL DRIVING CIRCUIT AND METHOD, AND DISPLAY DEVICE

(71) Applicants: Chengdu BOE Optoelectronics Technology Co., Ltd., Chengdu (CN); BOE TECHNOLOGY GROUP CO., LTD., Beijing (CN)

(72) Inventor: Yingsong Xu, Beijing (CN)

(73) Assignees: Chengdu BOE Optoelectronics Technology Co., Ltd., Chengdu (CN); BOE TECHNOLOGY GROUP CO., LTD., Beijing (CN)

( * ) Notice: Subject to any disclaimer, the term of this patent is extended or adjusted under 35 U.S.C. 154(b) by 237 days.

(21) Appl. No.: 16/607,535

(22) PCT Filed: Feb. 27, 2019

(86) PCT No.: PCT/CN2019/076235
§ 371 (c)(1),
(2) Date: Oct. 23, 2019

(87) PCT Pub. No.: WO2019/227989
PCT Pub. Date: Dec. 5, 2019

(65) Prior Publication Data

US 2021/0335222 A1 Oct. 28, 2021

(30) Foreign Application Priority Data

May 29, 2018 (CN) ..... 201810534482.7

(51) Int. Cl.
*G09G 3/325* (2016.01)
*G09G 3/3266* (2016.01)
*G09G 3/3283* (2016.01)

(52) U.S. Cl.
CPC ..... *G09G 3/325* (2013.01); *G09G 3/3266* (2013.01); *G09G 3/3283* (2013.01); *G09G 2320/0233* (2013.01)

(58) Field of Classification Search
CPC .... G09G 3/325; G09G 3/3233; G09G 3/3266; G09G 3/3283; G09G 2300/0426;
(Continued)

(56) References Cited

U.S. PATENT DOCUMENTS 6,847,172 B2 1/2005 Suzuki
7,973,746 B2 * 7/2011 Han ..... G09G 3/3233 345/78

(Continued)

FOREIGN PATENT DOCUMENTS

CN 102290027 A 12/2011
CN 102290027 B 10/2013

(Continued)

OTHER PUBLICATIONS

International Search Report and Written Opinion dated Jun. 10, 2019 for PCT Patent Application No. PCT/CN2019/076235.

(Continued)

*Primary Examiner* — Vijay Shankar
(74) *Attorney, Agent, or Firm* — Thomas Horstemeyer, LLP

(57) ABSTRACT

The present disclosure relates to display technologies and, in particular, to a pixel driving circuit, a pixel driving method, and a display device. The pixel driving circuit includes first to fifth switching elements, a driving transistor, a first storage capacitor, and a second storage capacitor. The pixel driving circuit can eliminate the influence on the driving current caused by the threshold voltage of the driving transistor, the voltage drop resulting from the wire resistance, and the aging of the electroluminescent element, so as (Continued)

to ensure the consistency of the driving current output by each pixel driving circuit and the uniformity of brightness of each pixel display.

16 Claims, 4 Drawing Sheets

(58) Field of Classification Search
CPC ... G09G 2300/0819; G09G 2300/0852; G09G 2300/0861; G09G 2320/045; G09G 2320/0219; G09G 2320/0223; G09G 2320/0233; G09G 2320/0238
See application file for complete search history.

(56) References Cited

U.S. PATENT DOCUMENTS

| | | | | |
|---|---|---|---|---|
| 9,620,574 | B2 * | 4/2017 | Lee | H01L 27/3274 |
| 10,360,848 | B2 * | 7/2019 | Wang | G09G 3/3233 |
| 10,803,794 | B2 * | 10/2020 | Cheng | G09G 3/3233 |
| 10,832,618 | B2 * | 11/2020 | Gao | G09G 3/3258 |
| 10,909,920 | B2 * | 2/2021 | Zhu | G09G 3/3233 |
| 2003/0098657 | A1 | 5/2003 | Suzuki | |
| 2009/0108763 | A1 * | 4/2009 | Han | G09G 3/3233 315/169.3 |
| 2016/0284784 | A1 * | 9/2016 | Lee | H01L 27/3241 |
| 2017/0025062 | A1 * | 1/2017 | Wang | G09G 3/3233 |
| 2018/0130412 | A1 | 5/2018 | Zhang et al. | |
| 2019/0096322 | A1 * | 3/2019 | Gao | G09G 3/3233 |

FOREIGN PATENT DOCUMENTS

| | | | |
|---|---|---|---|
| CN | 104143313 | A | 11/2014 |
| CN | 104200777 | A | 12/2014 |
| CN | 104409042 | A | 3/2015 |
| CN | 104680969 | A | 6/2015 |
| CN | 105489166 | A | 4/2016 |
| CN | 106952617 | A | 7/2017 |
| CN | 107369413 | A | 11/2017 |
| CN | 107767819 | A | 3/2018 |
| CN | 108766353 | A | 11/2018 |
| CN | 106952617 | B | 1/2019 |
| WO | 2018210051 | A1 | 11/2018 |

OTHER PUBLICATIONS

1st Office Action dated Aug. 27, 2019 for Chinese Patent Application No. 201810534482.7.

* cited by examiner

PIXEL DRIVING CIRCUIT AND METHOD, AND DISPLAY DEVICE

This application is a § 371 national phase application of PCT/CN2019/076235 filed Feb. 27, 2019, which claims the benefit of and priority to Chinese Patent Application No. 201810534482.7, filed on May 29, 2018, where the contents of which are incorporated by reference in their entireties herein.

TECHNICAL FIELD

The present disclosure relates to the display technologies and particularly to a pixel driving circuit, a pixel driving method, and a display device.

BACKGROUND

As a current-type light-emitting device, Organic Light Emitting Diode (OLED) is increasingly used among the high-performance display areas for its self-illumination, fast response, wide viewing angle, and its ability to be fabricated on flexible substrates. OLED display devices can be classified into two types: PMOLED (Passive Matrix Driving OLED) and AMOLED (Active Matrix Driving OLED). AMOLED has gained increasing attention from display technology developers due to its low manufacturing cost, high response speed, power saving, direct current drive for portable devices, and large operating temperature range.

SUMMARY

The objective of the present disclosure is to provide a pixel driving circuit, a pixel driving method, and a display device, which at least to some extent overcome the uneven brightness of the display caused by the threshold voltage of the driving transistor and the wire resistance and the aging of the electroluminescent element.

According to an aspect of the present disclosure, a pixel driving circuit for driving an electroluminescent element is provided. The pixel driving circuit includes:

a first switching element connected to a first node, and configured to be turned on in response to a first scan signal to transmit a data signal to the first node;

a driving transistor connected to a second node and a third node, and configured to be turned on in response to a signal from the second node, and output a driving current to the third node under action of a first power signal;

a second switching element connected to the second nod and the third node, and configured to be turned on in response to a second scan signal to connect the second node and the third node;

a third switching element connected to the first node and a first electrode of the electroluminescent element, and configured to be turned on in response to a first control signal to connect the first node and the first electrode of the electroluminescent element;

a fourth switching element connected to the third node and the first electrode of the electroluminescent element, and configured to be turned on in response to a second control signal to connect the third node and the first electrode of the electroluminescent element;

a fifth switching element connected to the first electrode of the electroluminescent element, and configured to be turned on in response to a reset signal to transmit a reference signal to the first electrode of the electroluminescent element.

According to an exemplary embodiment of the present disclosure, the pixel driving circuit further includes:

a first storage capacitor having a first terminal connected to the first node, and a second terminal connected to the second node; and a second storage capacitor having a first terminal connected to the second node, and a second terminal connected to the first electrode of the electroluminescent element.

According to an exemplary embodiment of the present disclosure, each of the first to fifth switching elements and the driving transistor has a control terminal, a first terminal, and a second terminal, and wherein:

a control terminal of the first switching element receives the first scan signal, a first terminal of the first switching element receives the data signal, and a second terminal of the first switching element is connected to the first node;

a control terminal of the driving transistor is connected to the second node, a first terminal of the driving transistor receives the first power signal, and a second terminal of the driving transistor is connected to the third node;

a control terminal of the second switching element receives the second scan signal, a first terminal of the second switching element is connected to the third node, and a second terminal of the second switching element is connected the second node;

a control terminal of the third switching element receives the first control signal, a first terminal of the third switching element is connected to the first electrode of the electroluminescent element, and a second terminal of the third switching element is connected to the first node;

a control terminal of the fourth switching element receives the second control signal, a first terminal of the fourth switching element is connected to the third node, and a second terminal of the fourth switching element is connected to the first electrode of the electroluminescent element;

a control terminal of the fifth switching element receives the reset signal, a first terminal of the fifth switching element receives a reference signal, and a second terminal of the fifth switching element is connected to the first electrode of the electroluminescent element.

According to an exemplary embodiment of the present disclosure, the pixel driving circuit is connected to a N-th row scan signal line and a (N−1)-th row scan signal line; wherein the N-th row scan signal line is configured to output the first scan signal, the (N−1)-th row scan signal line is configured to output the second scan signal; where N is a positive integer.

According to an exemplary embodiment of the present disclosure, a plurality of the pixel driving circuits are arranged in N rows, wherein the second scan signal in a n-th row of pixel driving circuits is used as the first scan signal in a (n−1)-th row of the pixel driving circuits, n is smaller than or equal to N, and N and n are integers.

According to an exemplary embodiment of the present disclosure, the switching elements are all P-type thin film transistors, the first terminals of the switching elements are all sources, and the second terminals of the switching elements are all drains.

According to an exemplary embodiment of the present disclosure, the switching elements are all N-type thin film transistors, the first terminals of the switching elements are all drains, and the second terminals of the switching elements are all sources.

According to an aspect of the present disclosure, there is provided a pixel driving method for driving the pixel driving circuit as described above. The pixel driving method includes:

in a first reset phase, turning on the second switching element by the second scan signal, turning on the third switching element by the first control signal, turning on the fourth switching element by the second control signal, turning on the fifth switching element by the reset signal, so as to transmit the reference signal to the first electrode of a electroluminescent element, the first node, the third node, and the second node;

in a second reset phase, turning on the second switching element by the second scan signal, turning on the third switching element by the first control signal, turning on the fifth switching element by the reset signal to write the first power signal and a threshold voltage of the driving transistor to the second node;

in a data writing phase, turning on the first switching element by the first scan signal, turning on the fifth switching element by the reset signal, so as to write the data signal to the first node, and write a difference between the data signal and the reference signal to the second node; and in a light emitting phase, turning on the third switching element by the first control signal, turning on the fourth switching element by the second control signal, so as to make the driving transistor turned on under action of signal from the second node, and output the driving current under action of the first power signal to drive the electroluminescent element to emit light.

According to an exemplary embodiment of the present disclosure, the switching elements are all P-type thin film transistors, the first terminals of the switching elements are all sources, and the second terminals of the switching elements are all drains.

According to an exemplary embodiment of the present disclosure, the switching elements are all N-type thin film transistors, the first terminals of the switching elements are all drains, and the second terminals of the switching elements are all sources.

According to an aspect of the present disclosure, there is provided a display device including the pixel drive circuit as described.

An exemplary embodiment of the present disclosure provides a pixel driving circuit and a pixel driving method, and a display device. The pixel driving circuit includes first to fifth switching elements, a driving transistor, a first storage capacitor, and a second storage capacitor. During the operation of the pixel driving circuit, on the one hand, in the second reset phase, a control terminal and a second terminal of the driving transistor are connected by turning on the second switching element, so that the threshold voltage of the driving transistor and a first power supply signal are written into a second node. In this way, the threshold voltage of the driving transistor is compensated, the influence of the threshold voltage of the driving transistor on the driving current is eliminated, the consistency of the driving current output by pixel driving circuits is ensured. Therefore, the uniformity of brightness of pixels is ensured. Also, the influence of the first power signal on the voltage between the control terminal and the first terminal of the driving transistor is eliminated, and therefore, the influence of the voltage drop resulted from the wire resistance (IR) on the display brightness of pixels is eliminated, and the consistency of the driving current output by each pixel driving circuit is ensured, and the uniformity of brightness of pixel displays is ensured. On the other hand, since the driving current output by the pixel driving circuit is proportional to the turn-on voltage of the electroluminescent element, and on the basis of this, after the electroluminescent element ages, the turn-on voltage of the electroluminescent element rises, thereby causing the driving current output by the pixel driving circuit to be increased to compensate the display brightness of the pixels. In this way, the phenomenon that the display brightness of pixels is not uniform due to the aging of the electroluminescent element can be avoided, and the uniformity of display brightness of pixels can be ensured. In addition, in the first reset phase, the reference signal is transmitted to the first electrode of the electroluminescent element, and the first node to the third node by turning on the second to fifth switching elements, so as to reset the first electrode of the electroluminescent element, the first node and the third node by the reference signal, and thus the influence of residual signal of the previous frame can be eliminated.

BRIEF DESCRIPTION OF THE DRAWINGS

The above and other features and advantages of this disclosure will become more apparent from exemplary embodiments described in detail with reference to the attached drawings. It is apparent that the drawings in the following description are only some exemplary embodiments of the present disclosure, and other drawings may be obtained by those ordinary skilled in the art without paying any creative labor. In the accompanying drawings.

DETAILED DESCRIPTION

Figure 1:
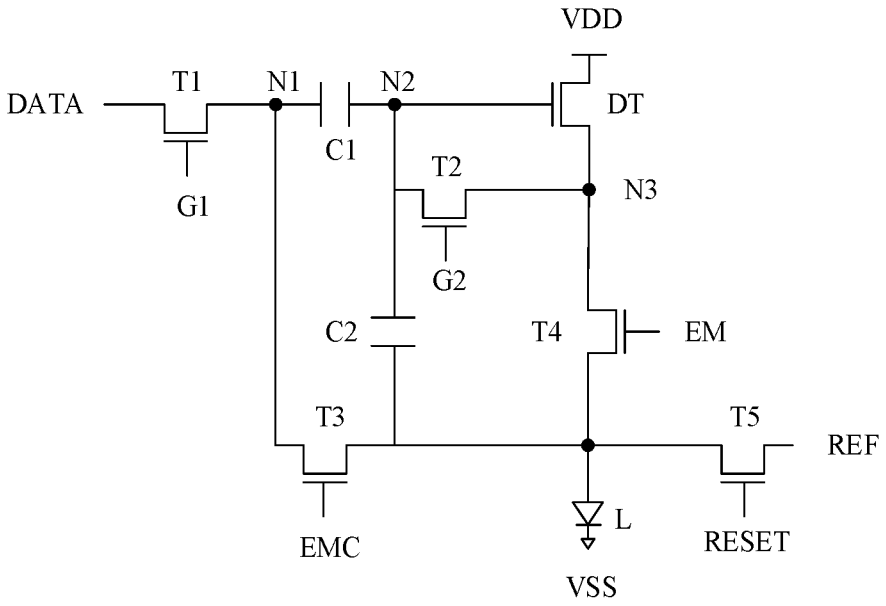
FIG. 1 is a schematic diagram of a pixel driving circuit according to an exemplary embodiment of the present disclosure.

Exemplary embodiments will now be described more fully with reference to the accompanying drawings. However, the exemplary embodiments can be embodied in a variety of forms, and should not be construed as limited in the examples set forth herein. On the contrary, these embodiments are provided so that this disclosure will be more comprehensive and complete, and the concept of the exemplary embodiments may be fully conveyed to those skilled in the art. The described features, structures, or characteristics may be combined in one or more embodiments in any suitable manner. In the following description, numerous specific details are provided for thorough comprehension to the embodiments of the present disclosure. However, those skilled in the art will appreciate that the technical solutions of the present disclosure can be implemented without one or more of specific details, or can be implemented by adopting other methods, elements, devices, steps, etc. In other cases, well-known technical solutions are not shown or described in detail, so as to avoid obscuring the aspects of the present disclosure.

In addition, the accompanying drawings are merely schematic representations of the present disclosure and are not necessarily drawn to scale. The same reference numerals in the drawings represent the same or similar parts, so the repeated description thereof will be omitted.

In current AMOLED display panels, each light emitting pixel has an independent pixel driving circuit for supplying a driving current for the pixel. Due to the process variations of the driving transistors in the driving circuits, the threshold voltages of driving transistors drift and are inconsistent, thereby leading to the driving current output by each pixel driving circuit being inconsistent, resulting in uneven brightness of pixels in display panels. In addition, since the lengths of the wires between the pixel driving circuits and the driving ICs that output the power supply voltages are different, the difference in the wire resistances causes the power supply voltages obtained by each of the pixel driving circuits to be different, so that when the same data signal voltage is input, different pixels have different current and brightness, resulting in uneven brightness of each pixel in the display panel. In addition, brightness of pixels is uneven as the aging of the electroluminescent element in the pixels.

Accordingly, it is desirable to provide a pixel driving circuit capable of overcoming the uneven brightness of the display caused by the threshold voltage of the driving transistor and the wire resistance and aging of the electroluminescence element.

In an exemplary embodiment, a pixel driving circuit for driving an electroluminescent element is provided. Referring to FIG. 1, the pixel driving circuit may include a first switching element T1, a driving transistor DT, a second switching element T2, a third switching element T3, a fourth switching element T4, a fifth switching element T5, a first storage capacitor C1, and a second storage capacitor C2.

The first switching element T1 is connected to a first node N1, and is configured to be turned on in response to a first scan signal G1 to transmit a data signal DATA to the first node N1. The driving transistor DT is connected to a second node N2 and a third node N3, and is configured to be turned on in response to a signal from the second node N2 to output a driving current to the third node N3 under the action of a first power signal VDD. The second switching element T2 is connected to the second node N2 and the third node N3, and is configured to be turned on in response to a second scan signal G2 to connect the second node N2 and the third node N3 (i.e., to enable current to flow through the second node N2 and the third node N3). The third switching element T3 is connected to the first node N1 and the first electrode of the electroluminescent element L, and is configured to be turned on in response to a first control signal EMC to connect the first node N1 and the first electrode of the light emitting element L. The fourth switching element T4 is connected to the third node N3 and the first electrode of the electroluminescent element L, and is configured to be turned on in response to a second control signal EM to connect the third node N3 and the first electrode of the electroluminescent element L. The fifth switching element T5 is connected to the first electrode of the electroluminescent element L, and is configured to be turned on in response to the reset signal RESET to transmit a reference signal REF to the first electrode of the electroluminescent element L. A first terminal of the first storage capacitor C1 is connected to the first node N1, and a second terminal of the first storage capacitor C1 is connected to the second node N2. A first terminal of the second storage capacitor C2 is connected to the second node N2, and a second terminal of the second storage capacitor C2 is connected to the first electrode of the electroluminescent element L.

During the operation of the pixel driving circuit, on the one hand, in the second reset phase, the control terminal, and the second terminal of the driving transistor DT are connected by turning on the second switching element T2, so that the threshold voltage VTH of the driving transistor DT and the first power supply signal VDD are written into the second node N2. In this way, the threshold voltage VTH of the driving transistor DT is compensated, the influence of the threshold voltage VTH of the driving transistor DT on the driving current is eliminated, and the consistency of the driving current output by pixel driving circuits is ensured. Therefore, the uniformity of brightness of pixels is ensured. Also, the influence of the first power signal VDD on the voltage between the control terminal and the first terminal of the driving transistor DT is eliminated, and therefore, the influence of the voltage drop resulted from the wire resistance on the display brightness of pixels is eliminated, the consistency of the driving current output by each pixel driving circuit is ensured, and the uniformity of brightness of pixel displays is ensured. On the other hand, since the driving current output by the pixel driving circuit is proportional to the turn-on voltage of the electroluminescent element L, and on the basis of this, after the electroluminescent element L ages, the turn-on voltage of the electroluminescent element L rises, thereby causing the driving current output by the pixel driving circuit to be increased to compensate the display brightness of the pixels. In this way, the phenomenon that the display brightness of pixels is not uniform due to the aging of the electroluminescent element L can be avoided, and the uniformity of display brightness of pixels can be ensured. In addition, in the first reset phase, the reference signal REF is transmitted to the first electrode of the electroluminescent element L, and the first node to the third node N1 to N3 by turning on the second to fifth switching elements T2 to T5, so as to reset the first electrode of the electroluminescent element L, the first node, and the third node N1 to N3 by the reference signal REF, and thus the influence of residual signal of the previous frame can be eliminated.

In the present exemplary embodiment, all the first to fifth switching elements (T1~T5) and the driving transistor DT described above have a control terminal, a first terminal, and a second terminal. The connection relationship between the first to fifth switching elements (T1~T5) and the driving transistor DT in the pixel driving circuit is as follows:

A control terminal of the first switching element T1 receives the first scan signal G1, a first terminal of the first switching element T1 receives the data signal DATA, and a second terminal of the first switching element T1 is connected to the first node N1. A control terminal of the driving transistor DT is connected to the second node N2, a first terminal of the driving transistor DT receives the first power signal VDD, and a second terminal of the driving transistor DT is connected to the third node N3. A control terminal of the second switching element T2 receives the second scan signal G2, a first terminal of the second switching element T2 is connected to the third node N3, and a second terminal of the second switching element T2 is connected the second node N2. A control terminal of the third switching element T3 receives the first control signal EMC, a first terminal of the third switching element T3 is connected to the first electrode of the electroluminescent element L, and a second terminal of the third switching element T3 is connected to the first node N1. A second electrode of the electroluminescent element L is connected to the second power signal VSS. A control terminal of the fourth switching element T4 receives the second control signal EM, a first terminal of the fourth switching element T4 is connected to the third node N3, and a second terminal of the fourth switching element T4 is connected to the first electrode of the electroluminescent element L. A control terminal of the fifth switching element T5 receives the reset signal RESET, a first terminal of the fifth switching element T5 receives the reference signal REF, and a second terminal of the fifth switching element T5 is connected to the first electrode of the electroluminescent element L.

In the present exemplary embodiment, the first to fifth switching element (T1~T5) may correspond to the first to fifth switching transistors, respectively. Each of the switching transistors has a control terminal, a first terminal, and a second terminal, respectively. A control terminal of each switching transistor may be a gate, a first terminal of each switching transistor may be a source, and a second terminal of each switching transistor may be a drain; or a control terminal of each switching transistor may be a gate, a first terminal of each switching transistor may be a drain, and a first terminal of each switching transistor may be a source. For example, when the switching elements are all P-type thin film transistors, that is, the first to fifth switching elements (T1~T5) may correspond to the first to the fifth P-type thin film transistors, respectively, a first terminal of each of the switching elements may be a source, and a second terminal of each of the switching elements may be a drain. As another example, when the switching elements are also N-type thin film transistors, that is, the first to the fifth switching elements (T1~T5) may correspond to the first N-type thin film transistor to the fifth N-type thin film transistor, respectively, a first terminal of each of the switching elements may be a drain, and a second terminal of each of the switching elements may be a source. It should be noted that the above switching elements may also be other types of transistors, which is not limited in exemplary embodiments.

In addition, each of the switching transistors may be an enhancement transistor or a depletion transistor, which is not limited in exemplary embodiments. It should be noted that since the source and the drain of each switching transistor are symmetrical, the source and the drain of each switching transistor can be interchanged.

The driving transistor DT has a control terminal, a first terminal, and a second terminal. For example, the control terminal of the driving transistor DT may be a gate, the first terminal of the driving transistor DT may be a source, and the second terminal of the driving transistor DT may be a drain. As another example, the control terminal of the driving transistor DT may be a gate, the first terminal of the driving transistor DT may be a drain, and the second terminal of the driving transistor DT may be a source. In addition, the driving transistor DT may be an enhancement driving transistor or a depletion driving transistor, which is not limited in exemplary embodiments.

The types of the first storage capacitor C1 and the second storage capacitor C2 may be selected according to specific circuit requirements. For example, the first storage capacitor C1 and the second storage capacitor C2 may be MOS capacitors, metal capacitors, or double polysilicon capacitors, and the like, which is not limited in exemplary embodiments.

The electroluminescent element L is a current-driven electroluminescent element, for example, an OLED, which is controlled to emit light by a current flowing through the driving transistor DT, but the electroluminescent element L in the present exemplary embodiment is not limited thereto. Further, the electroluminescent element L has a first electrode and a second electrode. For example, the first electrode of the electroluminescent element L may be an anode and the second electrode thereof may be a cathode. For another example, the first electrode of the electroluminescent element L may be a cathode, and the second electrode of the electroluminescent element L may be an anode.

In the plurality of pixel driving circuits arranged in the array, in order to share or reuse the first scan signal G1 and the second scan signal G2 in the pixel driving circuits to simplify the circuit structure of the plurality of pixel driving circuits arranged in the array and realize row-by-row scanning, the pixel driving circuit is connected to the N-th row scan signal line and the (N+1)-th row scan signal line. The N-th row scan signal line is configured to output the first scan signal G1, and the (N−1)th row scan signal line is configured to output the second scan signal G2; N is a positive integer. Specifically, the first switching element T1 in the pixel driving circuit is connected to the N-th row scan signal line, and the second switching element T2 is connected to the N-lth row scan signal line.

Further, when a plurality of the pixel driving circuits are arranged in rows, in order to share or reuse the first scan signal G1 to simplify the circuit structure of the plurality of pixel driving circuits, the second scan signal G2 in the n-th row of the pixel driving circuits and the first scan signal G1 in the (n−1)-th row of the pixel drive circuits are shared, n is smaller than or equal to N, and N and n are integers. Specifically, the second scan signal G2 in the n-th row of pixel driving circuits is also used the first scan signal G1 in the (n−1)-th row of the pixel driving circuits.

Figure 7:
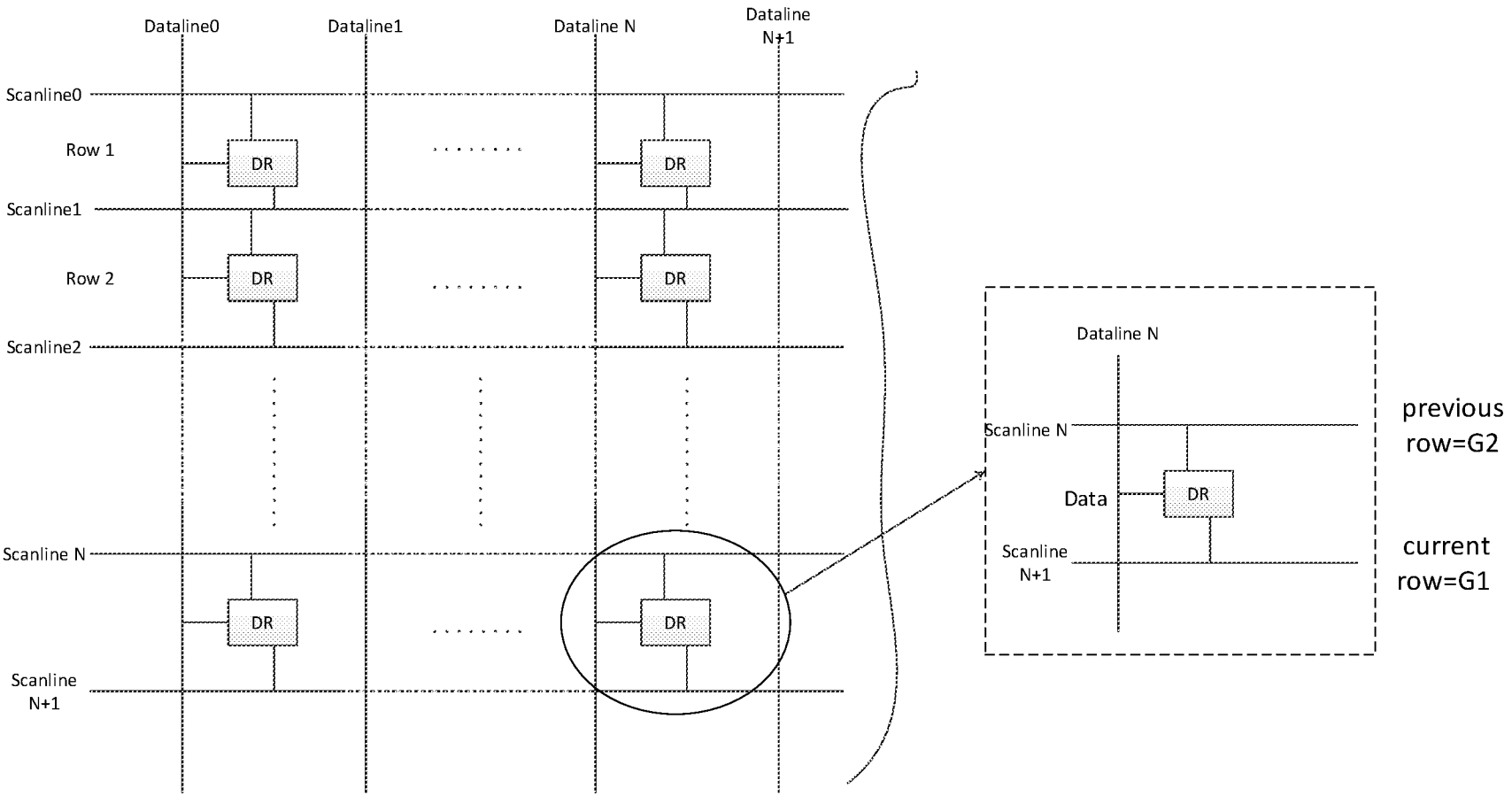
FIG. 7 is a schematic diagram of a pixel driving circuit according to an exemplary embodiment of the present disclosure.

FIG. 7 shows a schematic diagram of a pixel driving circuit according to an exemplary embodiment of the present disclosure. FIG. 7 shows a plurality of pixel drive circuits DR arranged in an array. A plurality of scan lines Scanline0, Scanline1, . . . ScanlineN, ScanlineN+1 extending in the horizontal direction, and a plurality of data lines Dataline0, Dataline1, DatalineN, DatalineN+1 extending in the vertical direction are arranged on the substrate. The plurality of scan lines are used to provide scan signals to each row (Row1, Row2, . . . ) of pixels, and the plurality of data lines are used to provide data signal DATA to each column of pixels. Each pixel driving unit DR corresponds to one pixel to drive the pixel to emit light. In order to share the scan signal, a pixel driving unit corresponding to a certain pixel in the (N+1)-th row of pixels (see, for example, the DR marked by the circle) may be connected to the N-th row scan line ScanlineN and the (N+1)-th row scan line ScanlineN+1. The signal G2 for the pixel driving unit may be an output signal from the N-th row scan line, and the signal G1 for the pixel driving unit may be an output signal from the (N+1)th row the scan line.

Figure 2:
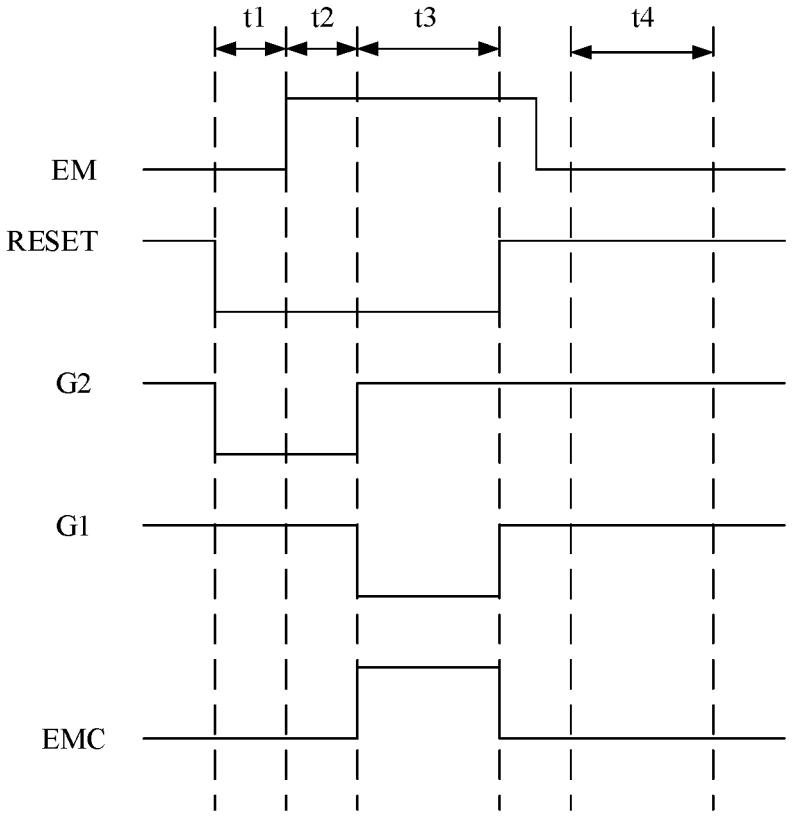
FIG. 2 is an operation timing diagram of a pixel driving circuit according to an exemplary embodiment of the present disclosure.

In an exemplary embodiment of the present disclosure, there is also provided a pixel driving method for driving a pixel driving circuit as shown in FIG. 1. Hereinafter, the operation procedure of the pixel driving circuit in FIG. 1 will be described in detail with reference to the operation timing chart of the pixel driving circuit shown in FIG. 2. In the following example, the switching elements are P-type thin film transistors and the driving transistor is a P-type driving transistor. Since the switching elements are all P-type thin film transistors, the first terminals of the switching elements are all sources, the second terminals of the switching elements are all drains, and the on-signals of the switching elements are all low level signals, and the off-signals of the switching elements are all high level signals. The drive timing diagram depicts the first scan signal G1, the second scan signal G2, the first control signal EMC, the second control signal EM, and the reset signal RESET.

Figure 3:
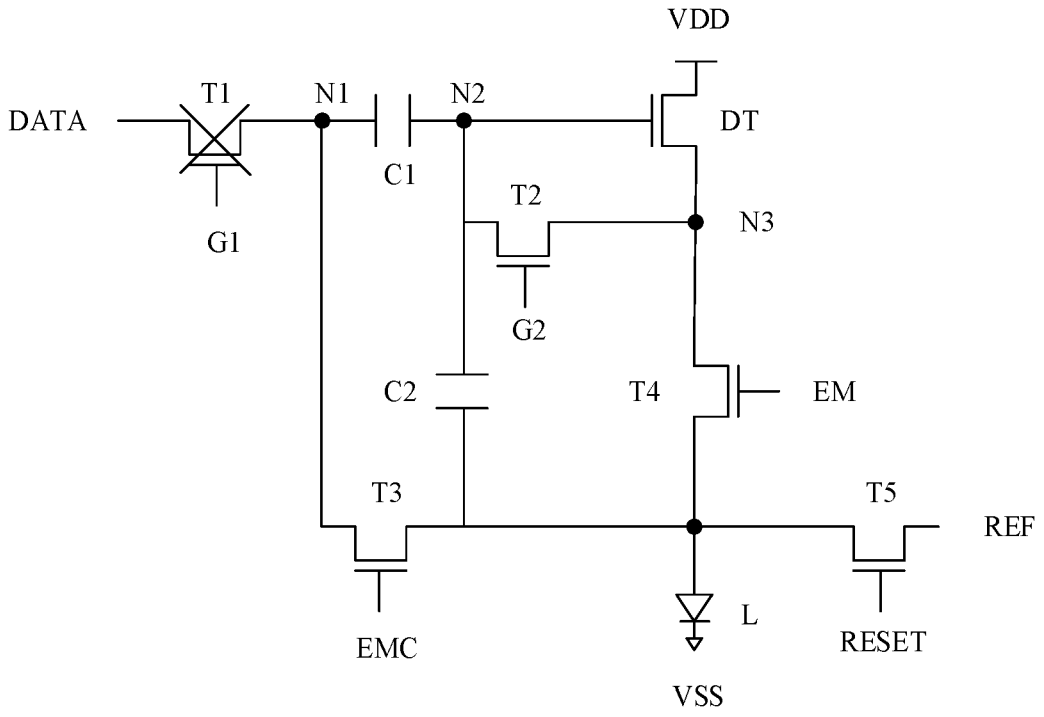
FIG. 3 is an equivalent circuit diagram of a pixel driving circuit in a first reset phase according to an exemplary embodiment of the present disclosure.

In a first reset phase (i.e., the t1 period), the second switching element T2 is turned on by the second scan signal G2, the third switching element T3 is turned on by the first control signal EMC, the fourth switching element T4 is turned on by the second control signal EM and the fifth switching element T5 is turned on by the reset signal RESET, so as to transmit the reference signal REF to the first electrode of a electroluminescent element L, the first node N1, the third node N3, and the second node N2. In the exemplary embodiment, the first scan signal G1 is a high level signal, the second scan signal G2 is a low level signal, the first control signal EMC is a low level signal, the second control signal EM is a low level, and the reset signal RESET is a low level signal. As shown in FIG. 3, the first switching element T1 is turned off, and the second switching element T2, the third switching element T3, the fourth switching element T4, and the fifth switching element T5 are all turned on. The reference signal REF is transmitted to the first electrode of the electroluminescent element L, the first node N1, the third node N3, and the second node N2 through the fifth switching element T5, the third switching element T3, the fourth switching element T4, and the second switching element T2, so as to reset the first electrode of the electroluminescent element L, the first node N1, the third node N3, and the second node N2 to eliminate the influence of the residual signal of the previous frame. It should be noted that at this time, the voltages at the first electrode of the electroluminescent element L, the first node N1, the third node N3, and the second node N2 are the voltage VREF of the reference signal REF.

Figure 4:
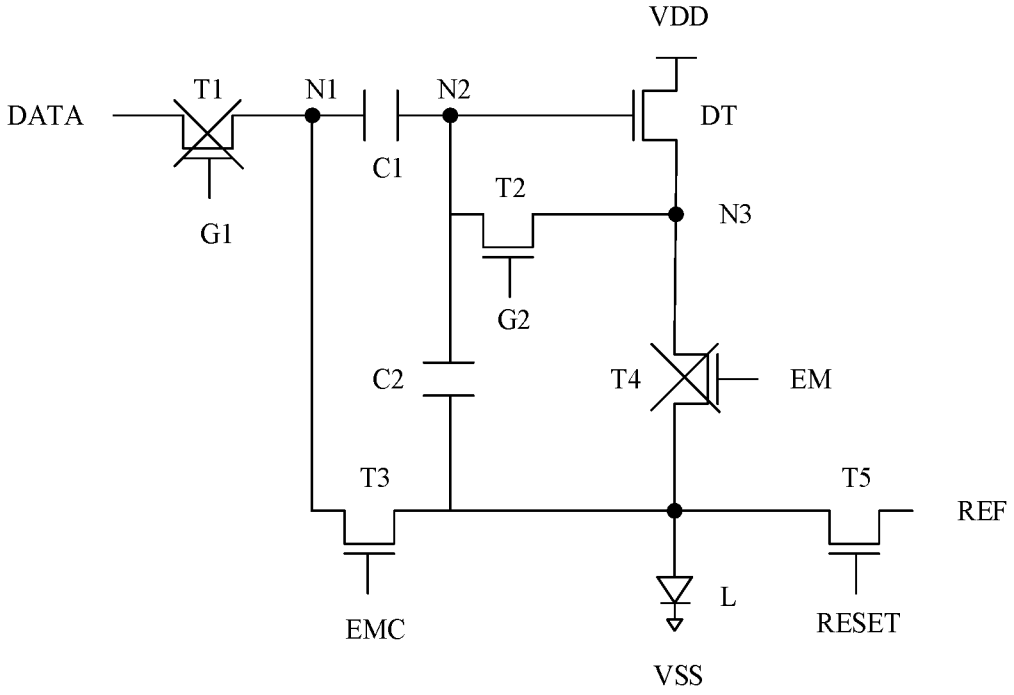
FIG. 4 is an equivalent circuit diagram of a pixel driving circuit in a second reset phase according to an exemplary embodiment of the present disclosure.

In a second reset phase (i.e., the t2 time period), the second switching element T2 is turned on by the second scan signal G2, the third switching element T3 is turned on by the first control signal EMC, and the fifth switching element T5 is turned on by the reset signal RESET, so as to write the first power signal VDD and the threshold voltage VTH of the driving transistor DT to the second node N2. In the present exemplary embodiment, the first scan signal G1 is a high level signal, the second scan signal G2 is a low level signal, the first control signal EMC is a low level signal, the second control signal EM is a high level signal, and the reset signal RESET is a low level signal. As shown in FIG. 4, the first switching element T1 and the fourth switching element T4 are both turned off, and the second switching element T2, the third switching element T3, and the fifth switching element T5 are all turned on. Since the second switching element T2 is turned on, the control terminal and the second terminal of the driving transistor DT are conducted with each other, so that the first power supply signal VDD and the threshold voltage VTH of the driving transistor DT are written into the second node N2, that is, the first storage capacitor C1 and the second storage capacitor C2 are charged. At this time, the voltage signals at the second node N2 and the third node N3 are both VDD+VTH. Since the fifth switching element T5 and the third switching element T3 are turned on, the voltages at the first electrode of the electroluminescent element L and the first node N1 are still the voltage VREF of the reference signal REF.

Figure 5:
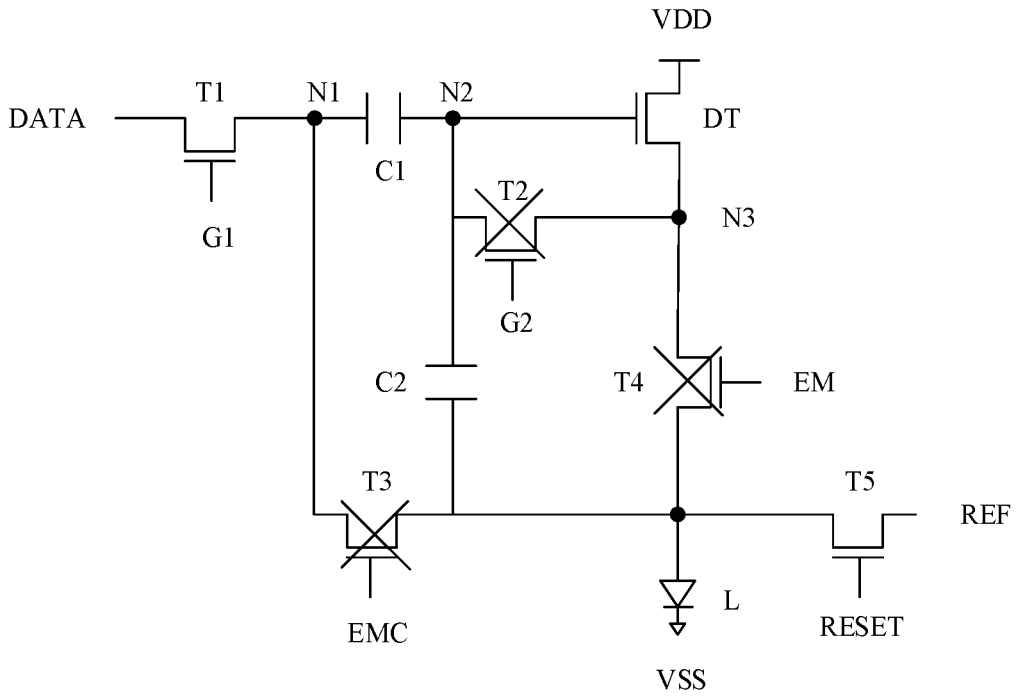
FIG. 5 is an equivalent circuit diagram of a pixel driving circuit in a data writing phase according to an exemplary embodiment of the present disclosure.

In the data writing phase (i.e., the t3 period), the first switching element T1 is turned on by the first scan signal G1, and the fifth switching element T5 is turned on by the reset signal RESET to write the data signal DATA to the first node N1, and to write the difference between the data signal DATA and the reference signal REF to the second node N2. In the exemplary embodiment, the first scan signal G1 is a low level signal, the second scan signal G2 is a high level signal, the first control signal EMC is a high level signal, the second control signal EM is a high level signal, and the reset signal RESET is a low level signal. As shown in FIG. 5, the first switching element T1 and the fifth switching element T5 are turned on, and the second switching element T2, the third switching element T3, and the fourth switching element T4 are turned off. The data signal DATA is transmitted to the first node N1 through the first switching element T1, and therefore, the voltage at the first node N1 becomes the voltage VDATA of the data signal DATA, and the voltage variation of the first node N1 is VDATA−VREF. At the same time, the voltage at the second node N2 is changed from VDD+VTH to VDD+VTH+VDATA−VREF due to the bootstrap of the first storage capacitor C1. Since the fifth switching element T5 is turned on, the voltage at the first electrode of the electroluminescent element L is still the voltage VREF of the reference signal REF.

Figure 6:
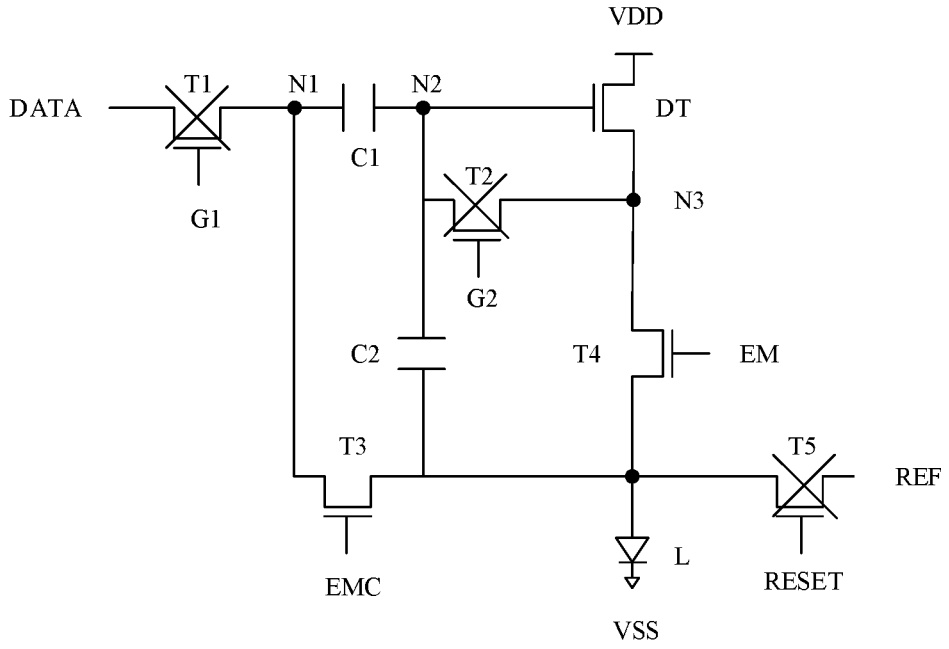
FIG. 6 is an equivalent circuit diagram of a pixel driving circuit in a light emitting phase according to an exemplary embodiment of the present disclosure.

In the light emitting phase (i.e., the time period t4), the third switching element T3 is turned on by the first control signal EMC, and the fourth switching element T4 is turned on by the second control signal EM, so as to make the driving transistor DT turned on by the signal from the second node N2, and to output a driving current under the action of the first power signal VDD to drive the electroluminescent element L to emit light. In the exemplary embodiment, the first scan signal G1 is a high level signal, the second scan signal G2 is a high level signal, the first control signal EMC is a low level signal, the second control signal EM is a low level signal, and the reset signal RESET is a high level signal. As shown in FIG. 6, the first switching element T1, the second switching element T2, and the fifth switching element T5 are all turned off, and the third switching element T3 and the fourth switching element T4 are turned on. The driving transistor DT is turned on by the signal from the second node N2, and the driving current is output under the action of the first power signal VDD. The driving current is transmitted to the electroluminescent element L through the fourth switching element T4 to drive the electroluminescence element to emit light. At this time, the voltage at the first electrode of the electroluminescent element L and the first node N1 and the third node N3 becomes the on-voltage VL of the electroluminescent element L, and the voltage at the second node N2 becomes VX.

On this basis, according to the calculation formula of the driving current of the driving transistor DT:

$$\begin{aligned} \text{Ion} &= K \times (Vgs - Vth)^2 = K \times (Vg - Vs - Vth)^2 \\ &= K \times (VX - VDD - Vth)^2 \end{aligned}$$

where Vgs is the voltage difference between the gate and the source of the driving transistor DT, Vg is the gate voltage of the driving transistor DT, Vs is a source voltage of the driving transistor DT, and Vth is the threshold voltage of the driving transistor DT.

According to the principle of charge conservation, that is, the charge in the pixel driving circuit in the data writing phase (i.e., the t3 period) is the same as the charge in the pixel driving circuit in the light emitting phase (i.e., the t4 period), the following formula can be obtained:

$$(VDD+VTH+VDATA-VREF-VDATA)C1+(VDD+VTH+VDATA-VREF-VREF)C2=(VX-VL-VSS)(C1+C2)$$

The following equation can be obtained by solving the above formula:

$$VX=VDD+Vth+VDATA-VREF-(VDATA*C1+VREF*C2)/(C1+C2)+(VL+VSS)$$

The following equation can be obtained by substituting VX into the calculation formula of the driving current of the driving transistor DT:

$$Ion=K\times(VDATA-VREF-(VDATA*C1+VREF*C2)/(C1+C2)+(VL+VSS))^2$$

It can be seen that the driving current is independent of the threshold voltage VTH of the driving transistor DT and the voltage of the first power supply signal VDD. Therefore, in the second reset phase ((i.e., the t2 period)), the control terminal and the second terminal of the driving transistor DT are connected with each other by turning on the second switching element T2, so that the threshold voltage VTH of the driving transistor DT and the first power supply signal VDD are written into the second node N2, that is, the threshold voltage VTH of the driving transistor DT is compensated, the influence of the threshold voltage VTH of the driving transistor DT on the driving current is eliminated, the consistency of the driving current output by pixel driving circuits is ensured, and therefore, the uniformity of brightness of pixels is ensured. At the same time, the influence of the first power signal VDD on the voltage between the control terminal and the first terminal of the driving transistor DT is eliminated, and therefore, the influence of the voltage drop resulted from the wire resistance on the display brightness of pixels is eliminated. Consequently, the consistency of the driving current output by each pixel driving circuit is ensured, and the uniformity of brightness of each pixel is ensured in the illuminating phase (i.e., the t4 period).

In addition, it can be seen from the above formula that the driving current is proportional to the on-voltage of the electroluminescent element L, and therefore, after the electroluminescent element L ages, the on-voltage of the electroluminescent element L rises, thereby causing the driving current output by the pixel driving circuit to be increased to compensate the display brightness of the pixels. In this way, the phenomenon that the display brightness of pixels is not uniform due to the aging of the electroluminescent element L can be avoided, and the uniformity of display brightness of pixels can e ensured.

If the transistors are all P-type thin film transistors, advantages such as strong noise suppression can be obtained. For example, the P-type thin film transistors are turned on by a low level, low level is easy to achieve in charge management. As another example, P-type thin film transistors have simple manufacturing processes and are relatively cheap. As another example, P-type thin film transistors have better stability, and so on.

It should be noted that, in the foregoing exemplary embodiments, all the switching elements are P-type thin film transistors; however, those skilled in the art can easily obtain a pixel driving circuit in which all switching elements are N-type thin film transistors according to the pixel driving circuit provided by embodiments of the present disclosure. In an exemplary embodiment of the present disclosure, all of the switching elements may be N-type thin film transistors. Since the switching elements are all N-type thin film transistors, the N-type thin film transistors are turned on by a high level, and the first terminals of the switching elements are drains, and the second terminals of the switching elements are sources. The pixel driving circuit provided by embodiments of the present disclosure may be changed to a CMOS (Complementary Metal Oxide Semiconductor) circuit or the like, and is not limited to the pixel driving circuit provided in embodiments of the present disclosure, and details are not described here.

An exemplary embodiment of the present disclosure also provides a display device including the above-described pixel driving circuit. The display device includes: a plurality of scan lines configured to provide scan signals; a plurality of data lines configured to provide data signals; a plurality of pixel drive circuits electrically connected to the scan lines and the data lines. At least one of the pixels driving circuit includes any of the above-described pixel driving circuits in the exemplary embodiments of the present disclosure. The display device may specifically be any product or member having a display function, such as a cell phone, a tablet computer, a TV, a notebook computer, a digital frame, a navigation device or the like. In the second reset phase, the control terminal and the second terminal of the driving transistor are connected by turning on the second switching element, so that the threshold voltage of the driving transistor and the first power supply signal are written into the second node. In this way, the threshold voltage of the driving transistor is compensated, the influence of the threshold voltage of the driving transistor on the driving current is eliminated, and the consistency of the driving current output by pixel driving circuits is ensured. Therefore, the uniformity of brightness of pixels is ensured. Also, the influence of the first power signal on the voltage between the control terminal and the first terminal of the driving transistor is eliminated, and therefore, the influence of the voltage drop resulted from the wire resistance on the display brightness of pixels is eliminated, the consistency of the driving current output by each pixel driving circuit is ensured, and the uniformity of brightness of pixel displays is ensured. On the other hand, since the driving current output by the pixel driving circuit is proportional to the turn-on voltage of the electroluminescent element, and on the basis of this, after the electroluminescent element ages, the turn-on voltage of the electroluminescent element rises, thereby causing the driving current output by the pixel driving circuit to be increased to compensate the display brightness of the pixels. In this way, the phenomenon that the display brightness of pixels is not uniform due to the aging of the electroluminescent element can be avoided, and the uniformity of display brightness of pixels can be ensured. In addition, in the first reset phase, the reference signal is transmitted to the first electrode of the electroluminescent element, and the first node to the third node by turning on the second to fifth switching elements, so as to reset the first electrode of the electroluminescent element, the first node and the third node by the reference signal, and thus the influence of residual signal of the previous frame can be eliminated.

It should be understood that specific details of each module or unit in the display device can be found in the previous descriptions regarding the pixel driving circuit, and repeated descriptions are omitted.

It should be noticed that, although several circuits or units of devices for action execution are mentioned in the detailed description above, such division is not mandatory. According to embodiments of the present disclosure, the features and functions of two or more modules or units described above may be embodied in one module or unit. On the contrary, the features and functions of one of the circuits or units described above may be further divided into a plurality of modules or units.

In addition, although various steps of the methods in the present disclosure are described in a specific order in the accompanying drawings, it is not required or implied that the steps must be performed in this specific order, or a desired result may be realized by performing all the steps shown. Additionally or alternatively, certain steps may be omitted, a plurality of steps may be combined into one step, and/or one step may be decomposed into a plurality of steps, and the like.

Other embodiments of the present disclosure will be apparent to those skilled in the art. The present application is intended to cover any variations, uses, or adaptations of the present disclosure, which are in accordance with the general principles of the present disclosure and include common general knowledge or conventional technical means in the art that are not disclosed in the present disclosure. The specification and examples should be construed as exemplary, and the real scope and spirit are defined by the appended claims.

INDUSTRIAL APPLICABILITY

The present disclosure relates to display technologies. The technical solutions of the present disclosure can eliminate the influence on the driving current caused by the threshold voltage of the driving transistor, the voltage drop resulted from the wire resistance, and the aging of the electroluminescent element, and ensure that the driving current output by pixel driving circuits is consistent, thereby ensuring the uniformity of display brightness of pixels.

What is claimed is:

1. A pixel driving circuit, comprising:

a first switching element connected to a first node, and configured to be turned on in response to a first scan signal to transmit a data signal to the first node;

a driving transistor connected to a second node and a third node, and configured to be turned on in response to a signal from the second node, and output a driving current to the third node under action of a first power signal;

a second switching element connected to the second nod and the third node, and configured to be turned on in response to a second scan signal to connect the second node and the third node;

a third switching element connected to the first node and a first electrode of the electroluminescent element, and configured to be turned on in response to a first control signal to connect the first node and the first electrode of the electroluminescent element;

a fourth switching element connected to the third node and the first electrode of the electroluminescent element, and configured to be turned on in response to a second control signal to connect the third node and the first electrode of the electroluminescent element; and a fifth switching element connected to the first electrode of the electroluminescent element, and configured to be turned on in response to a reset signal to transmit a reference signal to the first electrode of the electroluminescent element, wherein:

each of the first to fifth switching elements and the driving transistor has a control terminal, a first terminal, and a second terminal;

a control terminal of the first switching element receives the first scan signal, a first terminal of the first switching element receives the data signal, and a second terminal of the first switching element is connected to the first node;

a control terminal of the driving transistor is connected to the second node, a first terminal of the driving transistor receives the first power signal, and a second terminal of the driving transistor is connected to the third node;

a control terminal of the second switching element receives the second scan signal, a first terminal of the second switching element is connected to the third node, and a second terminal of the second switching element is connected the second node;

a control terminal of the third switching element receives the first control signal, a first terminal of the third switching element is connected to the first electrode of the electroluminescent element, and a second terminal of the third switching element is connected to the first node;

a control terminal of the fourth switching element receives the second control signal, a first terminal of the fourth switching element is connected to the third node, and a second terminal of the fourth switching element is connected to the first electrode of the electroluminescent element; and a control terminal of the fifth switching element receives the reset signal, a first terminal of the fifth switching element receives a reference signal, and a second terminal of the fifth switching element is connected to the first electrode of the electroluminescent element.

2. The pixel driving circuit of claim 1, wherein:

the pixel driving circuit is connected to a N-th row scan signal line and a (N−1)-th row scan signal line;

the N-th row scan signal line is configured to output the first scan signal, the (N−1)-th row scan signal line is configured to output the second scan signal; and N is a positive integer.

3. The pixel driving circuit of claim 1, wherein a plurality of the pixel driving circuits are arranged in N rows, wherein the second scan signal in a n-th row of pixel driving circuits is used as the first scan signal in a (n−1)-th row of the pixel driving circuits, n is smaller than or equal to N, N and n are integers.

4. The pixel driving circuit of claim 1, wherein the first to fifth switching elements are all P-type thin film transistors, the first terminals of the first to fifth switching elements are all sources, and the second terminals of the first to fifth switching elements are all drains.

5. The pixel driving circuit of claim 1, wherein the first to fifth switching elements are all N-type thin film transistors, the first terminals of the first to fifth switching elements are all drains, and the first to fifth second terminals of the switching elements are all sources.

6. The pixel driving circuit of claim 1, further comprising:

a first storage capacitor having a first terminal connected to the first node, and a second terminal connected to the second node; and a second storage capacitor having a first terminal connected to the second node, and a second terminal connected to the first electrode of the electroluminescent element.

7. A pixel driving method for driving a pixel driving circuit, comprising:

providing the pixel driving circuit, wherein the pixel driving circuit comprises:

a first switching element connected to a first node, and configured to be turned on in response to a first scan signal to transmit a data signal to the first node;

a driving transistor connected to a second node and a third node, and configured to be turned on in response to a signal from the second node, and output a driving current to the third node under action of a first power signal;

a second switching element connected to the second nod and the third node, and configured to be turned on in response to a second scan signal to connect the second node and the third node;

a third switching element connected to the first node and a first electrode of the electroluminescent element, and configured to be turned on in response to a first control signal to connect the first node and the first electrode of the electroluminescent element;

a fourth switching element connected to the third node and the first electrode of the electroluminescent element, and configured to be turned on in response to a second control signal to connect the third node and the first electrode of the electroluminescent element; and a fifth switching element connected to the first electrode of the electroluminescent element, and configured to be turned on in response to a reset signal to transmit a reference signal to the first electrode of the electroluminescent element;

in a first reset phase, turning on the second switching element by the second scan signal, turning on the third switching element by the first control signal, turning on the fourth switching element by the second control signal, turning on the fifth switching element by the reset signal, so as to transmit the reference signal to the first electrode of a electroluminescent element, the first node, the third node, and the second node;

in a second reset phase, turning on the second switching element by the second scan signal, turning on the third switching element by the first control signal, turning on the fifth switching element by the reset signal to write the first power signal and a threshold voltage of the driving transistor to the second node;

in a data writing phase, turning on the first switching element by the first scan signal, turning on the fifth switching element by the reset signal, so as to write the data signal to the first node, and write a difference between the data signal and the reference signal to the second node; and in a light emitting phase, turning on the third switching element by the first control signal, turning on the fourth switching element by the second control signal, so as to make the driving transistor turned on under action of signal from the second node, and output the driving current under action of the first power signal to drive the electroluminescent element to emit light.

8. The method of claim 7, wherein the first to fifth switching elements are all P-type thin film transistors, the first terminals of the first to fifth switching elements are all sources, and the second terminals of the first to fifth switching elements are all drains.

9. The method of claim 7, wherein the first to fifth switching elements are all N-type thin film transistors, the first terminals of the first to fifth switching elements are all drains, and the second terminals of first to fifth the switching elements are all sources.

10. The method of claim 7, wherein the pixel driving circuit further comprises:

a first storage capacitor having a first terminal connected to the first node, and a second terminal connected to the second node; and a second storage capacitor having a first terminal connected to the second node, and a second terminal connected to the first electrode of the electroluminescent element.

11. A display device comprising a pixel driving circuit, wherein the pixel driving circuit comprises:

a first switching element connected to a first node, and configured to be turned on in response to a first scan signal to transmit a data signal to the first node;

a driving transistor connected to a second node and a third node, and configured to be turned on in response to a signal from the second node, and output a driving current to the third node under action of a first power signal;

a second switching element connected to the second nod and the third node, and configured to be turned on in response to a second scan signal to connect the second node and the third node;

a third switching element connected to the first node and a first electrode of the electroluminescent element, and configured to be turned on in response to a first control signal to connect the first node and the first electrode of the electroluminescent element;

a fourth switching element connected to the third node and the first electrode of the electroluminescent element, and configured to be turned on in response to a second control signal to connect the third node and the first electrode of the electroluminescent element; and a fifth switching element connected to the first electrode of the electroluminescent element, and configured to be turned on in response to a reset signal to transmit a reference signal to the first electrode of the electroluminescent element, wherein:

each of the first to fifth switching elements and the driving transistor has a control terminal, a first terminal, and a second terminal;

a control terminal of the first switching element receives the first scan signal, a first terminal of the first switching element receives the data signal, and a second terminal of the first switching element is connected to the first node;

a control terminal of the driving transistor is connected to the second node, a first terminal of the driving transistor receives the first power signal, and a second terminal of the driving transistor is connected to the third node;

a control terminal of the second switching element receives the second scan signal, a first terminal of the second switching element is connected to the third node, and a second terminal of the second switching element is connected the second node;

a control terminal of the third switching element receives the first control signal, a first terminal of the third switching element is connected to the first electrode of the electroluminescent element, and a second terminal of the third switching element is connected to the first node;

a control terminal of the fourth switching element receives the second control signal, a first terminal of the fourth switching element is connected to the third node, and a second terminal of the fourth switching element is connected to the first electrode of the electroluminescent element; and a control terminal of the fifth switching element receives the reset signal, a first terminal of the fifth switching element receives a reference signal, and a second terminal of the fifth switching element is connected to the first electrode of the electroluminescent element.

12. The display device of claim 11, wherein the pixel driving circuit further comprises:

a first storage capacitor having a first terminal connected to the first node, and a second terminal connected to the second node; and a second storage capacitor having a first terminal connected to the second node, and a second terminal connected to the first electrode of the electroluminescent element.

13. The display device of claim 11, wherein the pixel driving circuit is connected to a N-th row scan signal line and a (N−1)-th row scan signal line; wherein the N-th row scan signal line is configured to output the first scan signal, the (N−1)-th row scan signal line is configured to output the second scan signal, wherein N is a positive integer.

14. The display device of claim 11, wherein a plurality of the pixel driving circuits are arranged in N rows, wherein the second scan signal in a n-th row of pixel driving circuits is used as the first scan signal in a (n−1)-th row of the pixel driving circuits, n is equal to or smaller than N, and N and n are integers.

15. The display device of claim 11, wherein the first to fifth switching elements are all P-type thin film transistors, the first terminals of the first to fifth switching elements are all sources, and the second terminals of the first to fifth switching elements are all drains.

16. The display device of claim 11, wherein the first to fifth switching elements are all N-type thin film transistors, the first terminals of the first to fifth switching elements are all drains, and the second terminals of the first to fifth switching elements are all sources.

* * * * *